United States Patent [19]

Shen

[11] Patent Number: 4,838,053

[45] Date of Patent: Jun. 13, 1989

[54] HEAVY-DUTY PANIC PROOF LOCK UNIT

[76] Inventor: Richard Shen, No. 233, Hai Tien Road, Sec. 2, Tainan, Taiwan

[21] Appl. No.: 171,417

[22] Filed: Mar. 21, 1988

[51] Int. Cl.[4] ..... E05B 65/10

[52] U.S. Cl. ..... 70/92; 70/107; 70/224; 292/92; 292/336.3

[58] Field of Search ..... 70/92, 107, 209, 215, 70/224, 451; 292/336.3, 347, 352, 92

[56] References Cited

U.S. PATENT DOCUMENTS

| | | | |
|---|---|---|---|
| 2,733,088 | 1/1956 | Fisler et al. | 292/336.3 X |
| 2,995,396 | 8/1961 | Russell et al. | 292/336.3 X |
| 3,390,558 | 7/1968 | Tornoe et al. | 70/107 |
| 3,621,685 | 11/1971 | Sargent | 70/107 |
| 3,999,789 | 12/1976 | Maurits et al. | 70/107 X |
| 4,129,019 | 12/1978 | Urdal | 70/107 |
| 4,156,541 | 5/1979 | Babb, Jr. et al. | 70/92 X |
| 4,201,069 | 5/1980 | Katayama et al. | 70/224 X |
| 4,276,760 | 7/1981 | Nolin | 70/92 X |

*Primary Examiner*—Gary L. Smith
*Assistant Examiner*—Suzanne L. Dino

[57] ABSTRACT

A heavy-duty panic proof lock unit comprising a latch bolt mechanism, a dead bolt mechanism, and a cartridge mechanism. The latch bolt mechanism cooperates with a primary spindle. The dead bolt mechanism cooperates with a secondary cylinder. The cartridge mechanism comprises a first cartridge plate, a second cartridge plate, a rocker lever, a collar, an H-shaped slide, a rotary lever, and a spring-loaded catch. The collar is a ring-shaped plate having approximately a same size with the opening of the drive ring of the rocker lever and comprises two outwardly projecting teeth at opposite locations respectively to cooperate with notches of the rocker lever. The collar also has an inwardly projecting tooth designed to fit in slide along the spindle slot and to transmit rotary force between the primary spindle and the rocker lever. The collar is entrapped in the opening of the drive ring, with the two outwardly projecting teeth thereof retained within the notches of the rocker lever. The notches are slightly larger than the outwardly projecting teeth so as to permit an extra 20 degree rotation of the collar at its both directions with respect to the rocker lever so that the latch bolt need not be cut or trimmed. The spindle of the lock unit is structurally reinforced in various locations so as to enhance the durability of the lock unit.

4 Claims, 13 Drawing Sheets

HEAVY-DUTY PANIC PROOF LOCK UNIT

BACKGROUND OF THE INVENTION

The present invention relates to door locks, and more particularly, to a so called "panic proof" interconnected locking mechanism having a separate latch bolt and dead bolt designed for installation in round bored openings in the edge and face of a door stile. A single action turn of the inside lever simultaneously retracts both latch and bolt for immediate exit.

A high security lock system for a building door normally involves both a latch bolt, for convenience in opening and closing a door, and a dead bolt for securely locking the door. Customarily, the dead bolt penetrates the jamb over an inch in order to protect against the possibility of the jamb or door being sprung enough to disengage the bolt from the jamb and may be extended and retracted with a key from the outside or a thumb turn from the inside. The latch bolt is normally knob operated from either side.

There have been a disturbing number of instances in which a person on the inside of a building in a panic situation, such as a fire or an earthquake, has failed to open a door leading to safety. This is simply because many people, under such panic conditions, fail to realize that the dead bolt and latch bolt must be both retracted in order to open the door.

To avoid such problem, there have been introduced the use of so-called "panic proof" locks: In "panic proof" locks, the latch bolt and dead bolt are independent mechanisms, as always, but an additional mechanism is provided to couple the interior knob to the dead bolt so that when the interior knob is turned, not only is the latch bolt retracted, but the dead bolt, if extended, is also retracted.

Prior art mechanisms for accomplishing the desired result are generally relatively complicated devices using levers and gears in combination. These devices are also unidirectional, that is, different parts are required for a lock for a left opening door and for a right opening door, resulting in extra expense and inconvenience.

U.S. Pat. No. 4,129,019 issued to Urdal entitled "Cartridge For A Lockset" has disclosed a rather simple lock construction, which can be installed in either left or right opening doors. In which, two individual, standard devices, collectively referred to as a lockset, are utilized on a door panel in connection with the door frame. The lock devices, usually entirely independent of each other, are joined together by a cartridge device interengaging with the spindles of the individual locks. The cartridge contains a mechanism for actuating both of the standard locks from one of the lock operators and is relatively thin and can be unobtrusively applied to installations already in existence and to new installations. The usual environment for the lockset cartridge is in connection with a door panel mounted on hinges in a door frame in a surrounding wall. The frame is provided with one or more strike boxes arranged to receive two bolts, a latch bolt and a dead bolt. In many installations the latch bolt is provided with a keyed operator on the exterior and a knob on the interior. The dead bolt is provided with a key actuator on the exterior and a thumb turn on the interior. The latch bolt mechanism governed by the controllers is a standard, independent lockset readily available and of a kind already installed on many door panels. Comparably, the mechanism of the dead bolt structure controlled by the key and the operator is itself a separate, standard mechanism as already installed in many door panels.

Urdal disclosure is useful when operated by a normal healthy person, but not when it is operated by a handicapped user. Lever type handles, as opposed to knob type handle, are preferably connected to the latch bolt mechanism for the convenience of handicapped users. However, lever type handles are not as rigid as knob type handles. Thus, a panic proof locksets of lever type handles need improvements and some sort of structural reinforcements to satisfy the requirements of handicapped users.

The function that rotation of the controller by itself will retract both the latch bolt and the dead bolt is valuable in a panic situation and though has been accomplished in Urdal's lock, it is done in an incomplete fashion. The cartridge has a drive ring which restricts the movement of the screws along the arcuate aperture and that the latch bolt need to be cut down in a shorter length. Herein the aim is to utilize a collar and to provide an extra rotation of about 20 degrees of the screw along the arcuate aperture such that the latch bolt need not be cut down into a shorter length.

SUMMARY OF THE INVENTION

It is, therefore, a primary object of the present invention to provide a panic proof lock unit with a lever type handle which is especially accessible by handicapped users.

Another object of the present invention is to provide a panic proof lock unit with a lever type handle having numerous structural reinforcements.

A further object of the present invention is to provide a panic proof lock unit having a cartridge that further comprises a collar in connection with the drive ring to permit an extra rotation of about 20 degrees of the screw along the arcuate aperture such that the latch bolt need not be cut down into a shorter length.

These and other objects of the present invention will become apparent after a careful reading of the specification provided hereinafter, with appropriate reference to the attached drawings.

DETAILED DESCRIPTION OF THE PREFERRED EMBODIMENT

Figure 1:
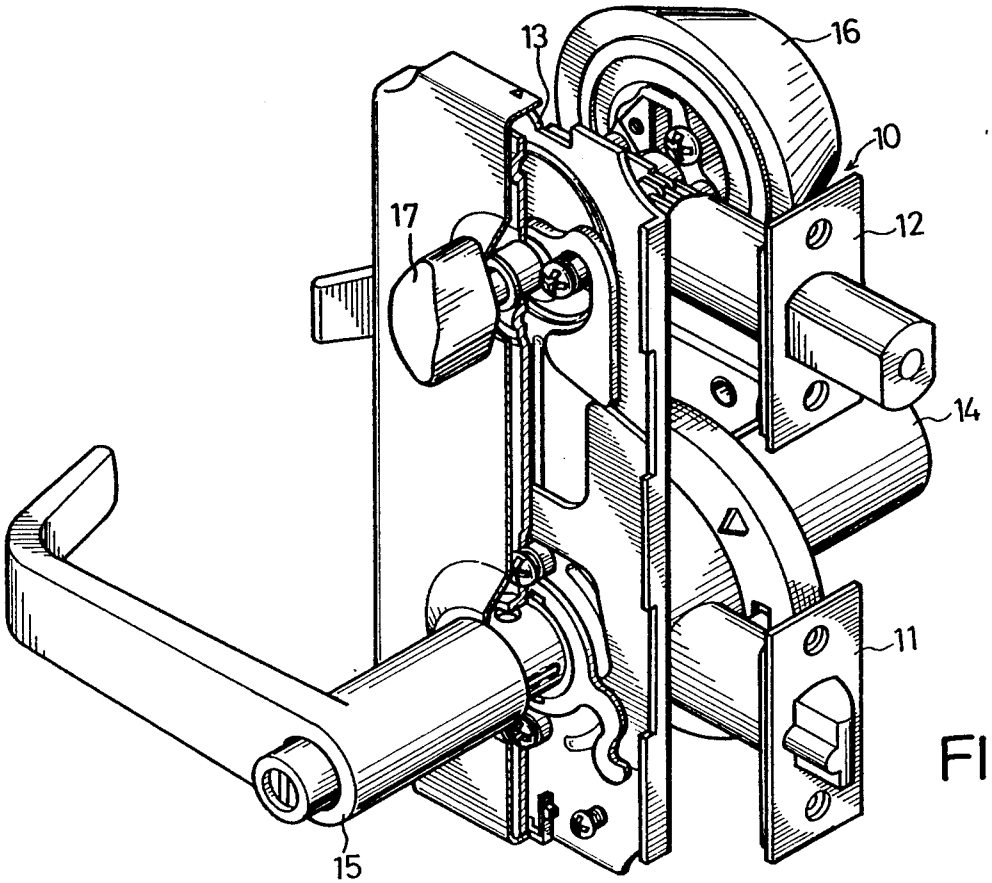
FIG. 1 is a perspective view of a panic proof lock unit having lever type handle in accordance with the present invention, a portion thereof being broken away for clarity.

Referring to the drawings and initially to FIG. 1, a heavy-duty panic proof lock unit in accordance with the present invention is generally referred to by the reference numeral 10. The panic proof lock unit 10 comprises a latch bolt mechanism 11, a dead bolt mechanism 12, and a cartridge mechanism 13. The latch bolt mechanism 11 is coupled with a key actuated exterior lever type handle 14, and an interior lever type handle 15. The dead bolt mechanism 12 is coupled with a key actuated rosette 16 on the exterior, and a thumb turn 17 on the interior. Such lock unit 10 is most preferred by handicapped users.

Figure 2:
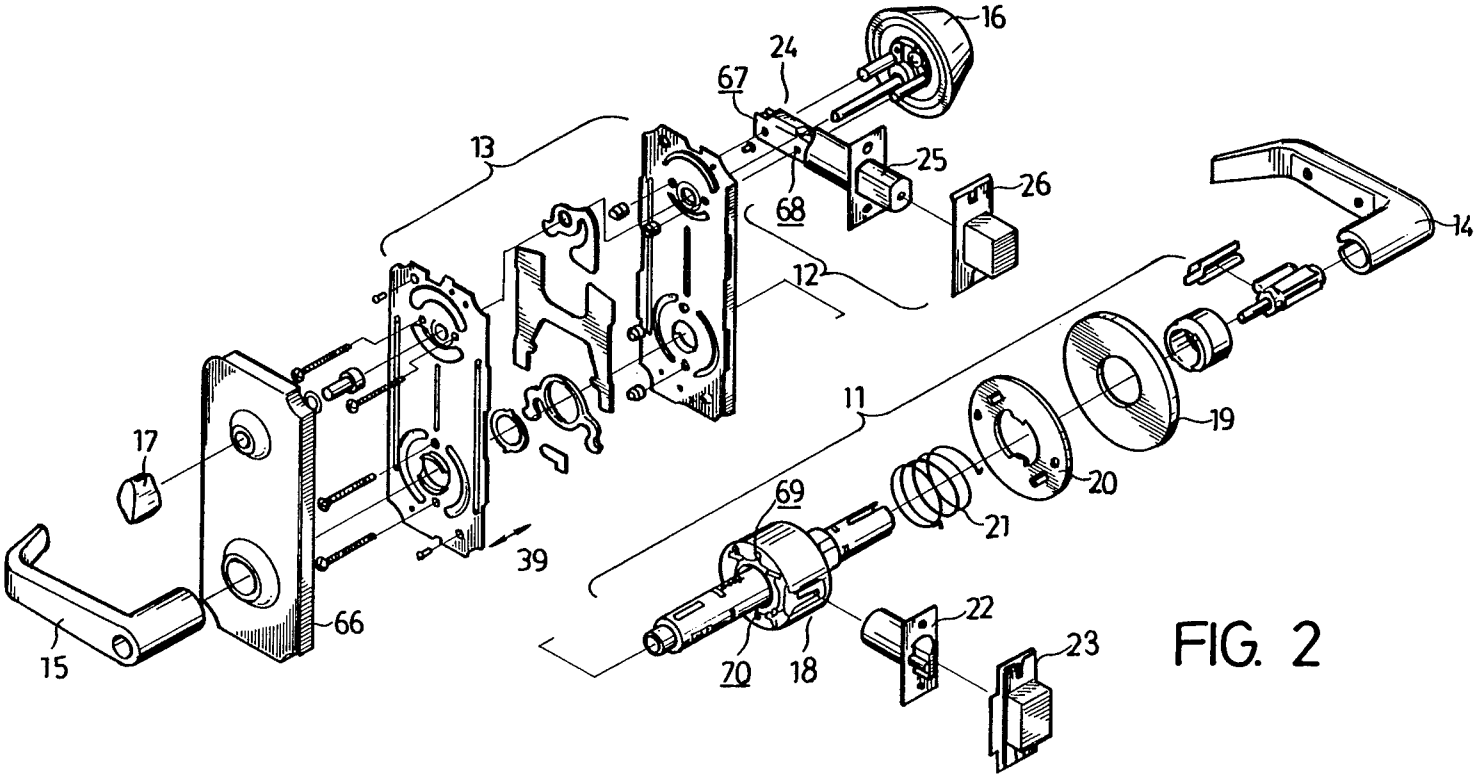
FIG. 2 is an exploded view in isometric projection showing the relationship of some of the parts of the lock unit shown in FIG. 1.

Referring to FIG. 2, it can be seen that the latch bolt mechanism 11, coupled with the exterior lever handle 14 and the interior lever handle 15 as previously mentioned, includes a primary cylindrical spindle 18 which connects the exterior lever handle 14 to the interior lever handle 15 in the conventional manner.

The latch bolt mechanism 11 further includes an escutcheon 19, a fixing plate 20, and a helical coil 21 fabricated in a conventional manner, so as to protect and to reinforce the primary cylindrical spindle 18. The latch bolt mechanism 11 indeed includes a latch bolt 22 extendable and retractable with respect to the recess of a primary striker plate 23 so as to close or open the door.

The dead bolt mechanism 12 coupled with the key actuated rosette 16 on the exterior and the thumb turn 17 on the interior, includes a secondary spindle 24 which connects the rosette 16 and the thumb turn 17. The dead bolt mechanism 12 indeed includes a dead bolt 25 extendable and retractable with respect to the recess of a secondary striker plate 26 as usual.

Figure 3:
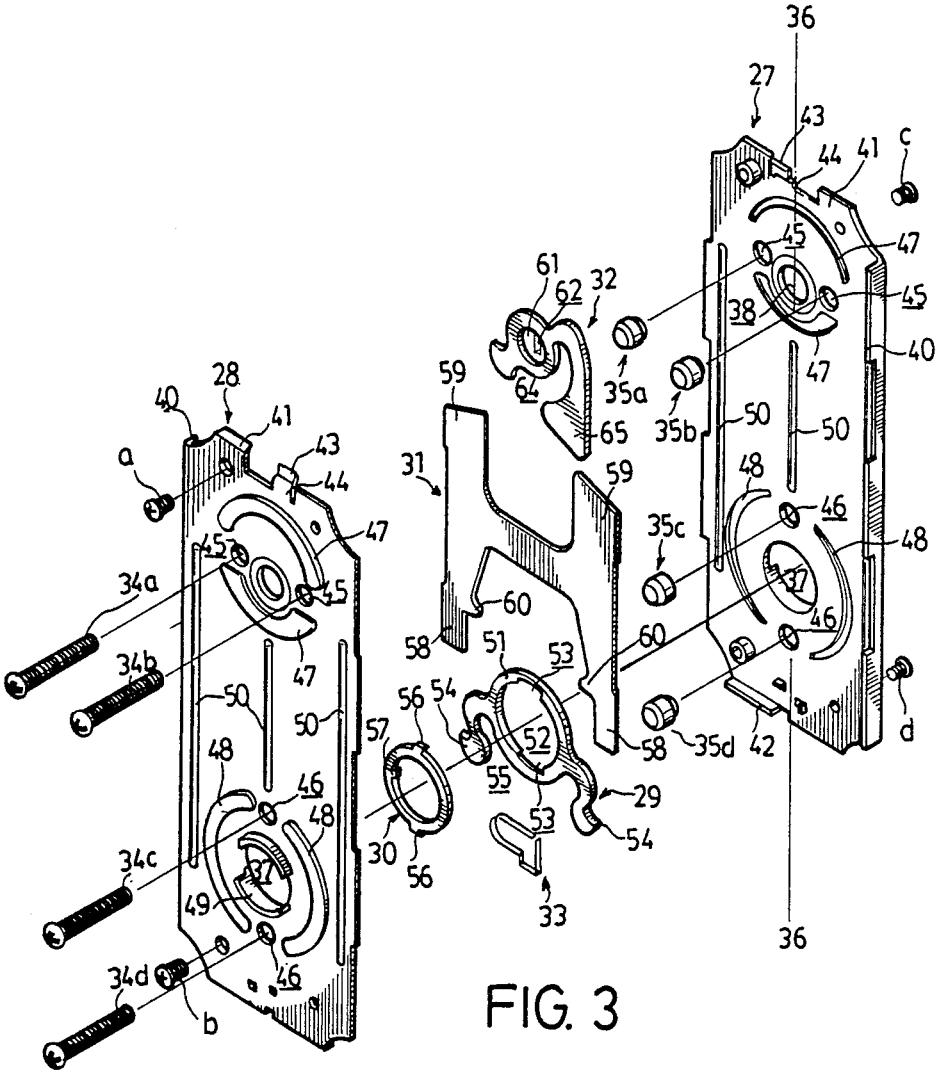
FIG. 3 is an exploded view of a cartridge constructed in accordance with the present invention.

Referring to FIG. 3, it can be seen that included in the cartridge mechanism 13 is a first cartridge plate 27, a second cartridge plate 28, a rocker lever 29, a collar 30, an H-shaped slide 31, a rotary lever 32, a spring-loaded catch 33, four screws 34*a*, 34*b*, 34*c*, 34*d* and four screw supporting shells 35*a*, 35*b*, 35*c*, 35*d*.

The cartridge plates, 27 and 28, are separate and distinct, but they are particularly made identical in configuration. The cartridge plate 27, being exemplary, is generally a rectangular, flat plate substantially symmetrical about a longitudinal axis 36. Piercing the plate is an opening 37 large enough to accommodate the primary cylindrical spindle 18 for ready rotation and another opening 38 large enough to accommodate the secondary spindle 24 for rotation, the openings 37 and 38 being spaced apart along the axis 36 at a proper distance to conform to the standard mounting of the two lock mechanisms.

The cartridge plates 27 and 28 are elaborately arranged with respect to each other so as to leave an intervening space 39. This is accomplished by providing on the plates along one edge an unturned edge flange 40 and also similar top and bottom flanges 41 and 42 respectively. Each of the flanges 40, 41 and 42 is of a dimension to provide the intervening space 39 when the two cartridge plates 27 and 28 are superposed with the flanges of one abutting the surface of another.

Although not limited thereto, it is preferable that a lug 43 projecting from a tab 44, to make certain that various openings 37 and 38 and other features of the cartridge plates 27 and 28 are in appropriate axial registry.

Each of the cartridge plates 27 and 28 has two pair of apertures 45 and 46 to receive through screws. Apertures 45 are provided at both side of the opening 38 horizontally, while apertures 46 are provided at an upper and lower part of the opening 37 in vertical alignment.

A pair of arcuate circumferential folds 47 are formed proximate to and around the opening 38, and another pair of arcuate circumferential folds 48 proximate to and around the opening 37 for purpose of strengthening the structures thereof. In addition, a pair of partial circumferential rims 49 around the opening 37 are formed to reinforce the structures thereof.

Each of the cartridge plates 27 and 28 is provided with three shallow grooves 50 to facilitate the up-and-down movement of the H-shaped slide 31. The H-shaped slide 31 and its movement will be described more fully hereinbelow.

Four short assembly screws a, b, c, and d, are provided to combine the two cartridge plates 27 and 28.

The rocker lever 29 is especially designed to be slidably assembled on the primary spindle 18. The rocker lever 29 is symmetrical about a median plane and includes a drive ring 51 having an opening 52 therethrough of a size capable of accommodating the primary spindle 18. The drive ring 51 has two oppositely spaced, inwardly concave notches 53 designed to cooperate with the collar 30. The rocker lever 29 also has a pair of lever arm 54 forming an unbounded intervening arcuate window 55.

The collar 30 is a ring-shaped plate having approximately a same size with the opening 52 of the drive ring 51 and comprises two outwardly projecting teeth 56 at two opposite locations respectively for cooperating with the previously mentioned notches 53. The collar 30 also has an inwardly projecting tooth 57 designed to fit in and to slide along the spindle slot and to transmit rotary force between the primary spindle 18 and the rocker lever 29.

The H-shaped slide 31 cooperates with the rocker lever 29. The slide 31 is generally a flat plate including two downwardly extending legs 58 and two upwardly extending legs 59. The two downwardly extending legs 58 are initially constant in width and at begin to be tapered in width at a suitable position. The two upwardly extending legs 59 are both constant in width which are convenient in either handling or assembly. An inwardly laterally projecting tab 60 is formed on each of the downwardly extending legs 58. The two inwardly projecting tabs 60 being faced toward each other are provided such that the configuration of the H-shaped slide 31 cooperates better with the rocker lever 29.

The rotary lever 32 is provided to cooperate with the secondary spindle 24. The rotary lever 32 is generally an arch-shaped flat plate including a central circular journal 61 having a rectangular slot 62 pierced therethrough to receive and slide in the secondary spindle 24 and to make the rotary lever 32 non-rotatable with respect thereto. The configuration of the rotary lever 32 forms arcuate cutout portions 63 and 64 which define passages for screws 34 and screw supporting shells 35. The rotary lever 32 includes a tail 65 having inclined face which matches the right upwardly extending legs 59 of the H-shaped slide 31, such that the rotary lever 32 cooperates better with the slide 31.

The spring-loaded catch 33 is a resilient metal wire emplaced below the rocker lever 29.

Referring back to FIG. 2, a face plate 66 of substantially the same size and shape as the cartridge plates 27 and 28 is preferably employed to mount on or to cover the cartridge mechanism 13 so s to prevent the cartridge mechanism 13 from exposure to the user on the inside. The face plate 66 has opening for accommodating the interior lever handle 15 and the thumb turn 17.

As can be seen in FIG. 2 and 3, a first screw indicated by reference numeral 34*a* passes through one of the apertures 45 of the second cartridge plate 28, the arcuate cutout portion 63, a first screw supporting shell 35*a*, the corresponding aperture 45 on the first cartridge plate 27, and finally engages with a first retention slot 67 of the dead bolt mechanism 12.

A second screw indicated by reference numeral 34*b* passes through another aperture 45 of the second cartridge plate 28, the arcuate cutout portion 64, a second screw supporting shell 35*b*, the corresponding aperture 45 on the first cartridge plate 27, and finally engages with a second retention slot 68 of the dead bolt mechanism 12.

A third screw indicated by reference numeral 34*b* passes through one of the apertures 46 of the second cartridge plate 28, a space between the H-shaped slide 31 and the rocker lever 29, a third screw supporting shell 35*c*, and the corresponding aperture 46 on the first cartridge plate 27, and finally engages with a third retention slot 69 of the latch bolt mechanism 11.

A fourth screw indicated by reference numeral 34*d* passes through another aperture 46 of the second cartridge plate 28, the unbounded arcuate window of the rocker lever 29, a fourth screw supporting shell 54*d*, and the corresponding aperture 46 on the first cartridge plate 27, and finally engages with a fourth retention slot 70 of the latch bolt mechanism 11.

The four screw supporting shells 35*a*, 35*b*, 35*c* and 35*d* are provided so as to make certain that the intervening space 39 is held unchanged after the screws 34*a*, 34*b*, 34*c*, and 34*d* are tightened.

Figure 4:
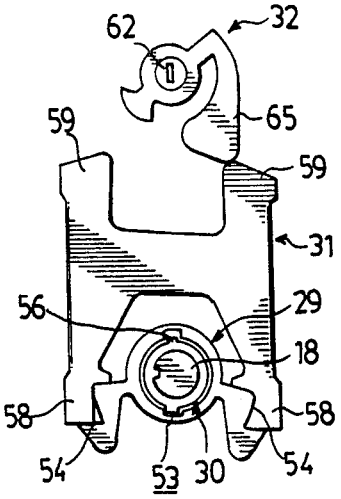
FIG. 4 is an enlarged view showing the combination of a rotary lever, an H-shaped slide, a rocker lever, a collar of the cartridge, an extended tongue of the dead bolt mechanism, and the cylindrical spindle of the latch bolt mechanism in a locked state.
Figure 5:
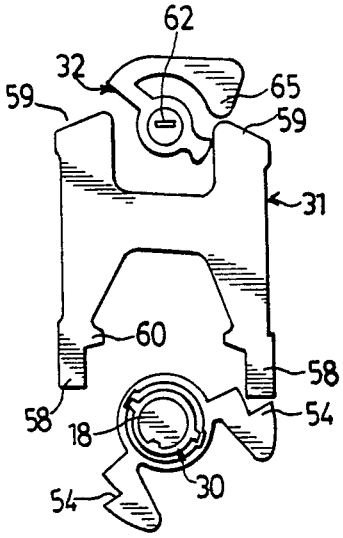
FIG. 5 is a view similar to FIG. 6, but illustrating the subsequent motion of the rocker lever, the H-shaped slide and the rotary lever when the lock unit is being unlocked.
Figure 6:
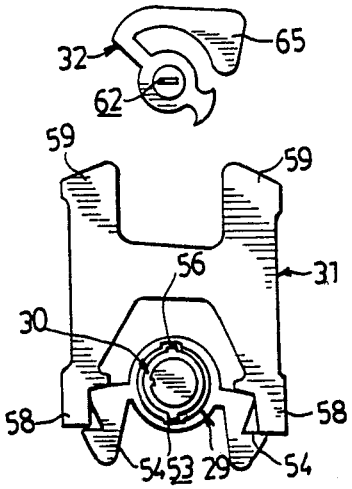
FIG. 6 is a view similar to FIG. 6, but illustrating the subsequent movement and position of the rocker lever due to spring force.

The interengaging action of the cartridge mechanism 13 is depicted most clearly in FIGS. 4, 5 and 6. When an indoor person turns the interior lever handle 15, the rocker lever 29 rotates counterclockwise and pushes the H-shaped slide 31 to move to a higher position. Thus, the rotary lever 32 rotates counter-clockwise which causes the dead bolt mechanism 12 originally in its locked state (FIG. 4) to be rotated to an unlocked state (FIG. 5).

Figure 7:
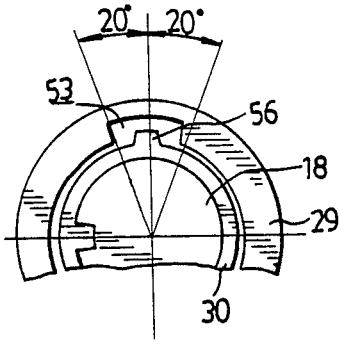
FIG. 7 is an expanded view from FIG. 6.

As will be clear from FIG. 7, an expanded view from FIG. 4, the collar 30 is entrapped in the opening 52 of the drive ring 51, with the two outwardly projecting teeth 56 thereof retained within the notches 53 of the rocker lever 29. The notches 53 are slightly larger than the teeth 56 so as to permit an extra 20 degrees of rotation of the collar 30 in either direction with respect to the rocker lever 29.

Figure 8:
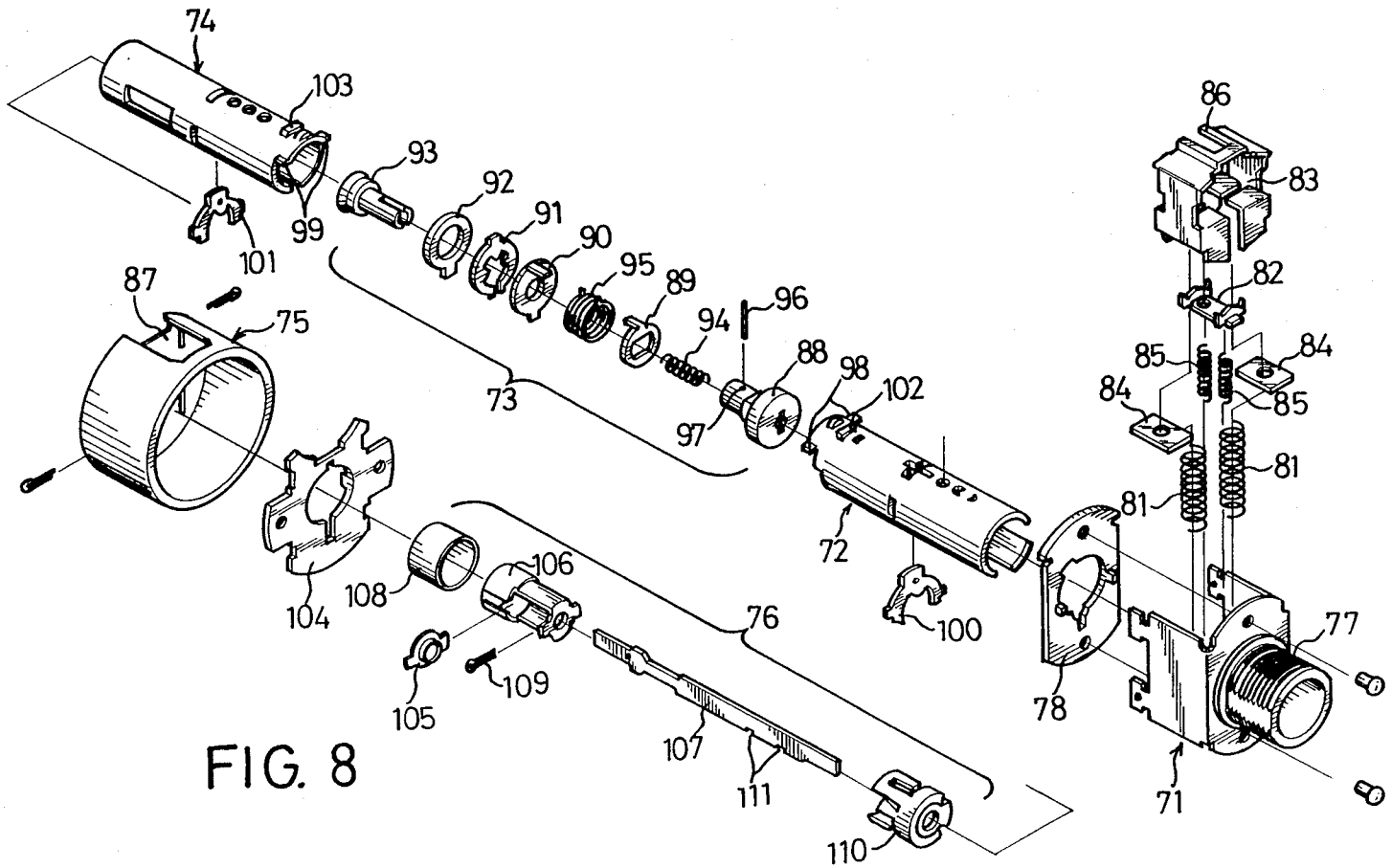
FIG. 8 is an exploded view of the primary cylindrical spindle of the latch bolt connected to the lever type handle in accordance with the present invention.

Referring next to FIG. 8, there is shown an exploded view of the primary cylindrical spindle 18. The primary cylindrical spindle 18 includes generally a hub 71, an exterior spindle 72, a locking plug assembly 73, an interior spindle 74, a housing 75, and a plunger assembly 76 fabricated in a conventional manner. The structure of each of the elements is similar to that of the conventional elements but with some reinforcements therein, as will be appreciated hereinafter.

Figure 9:
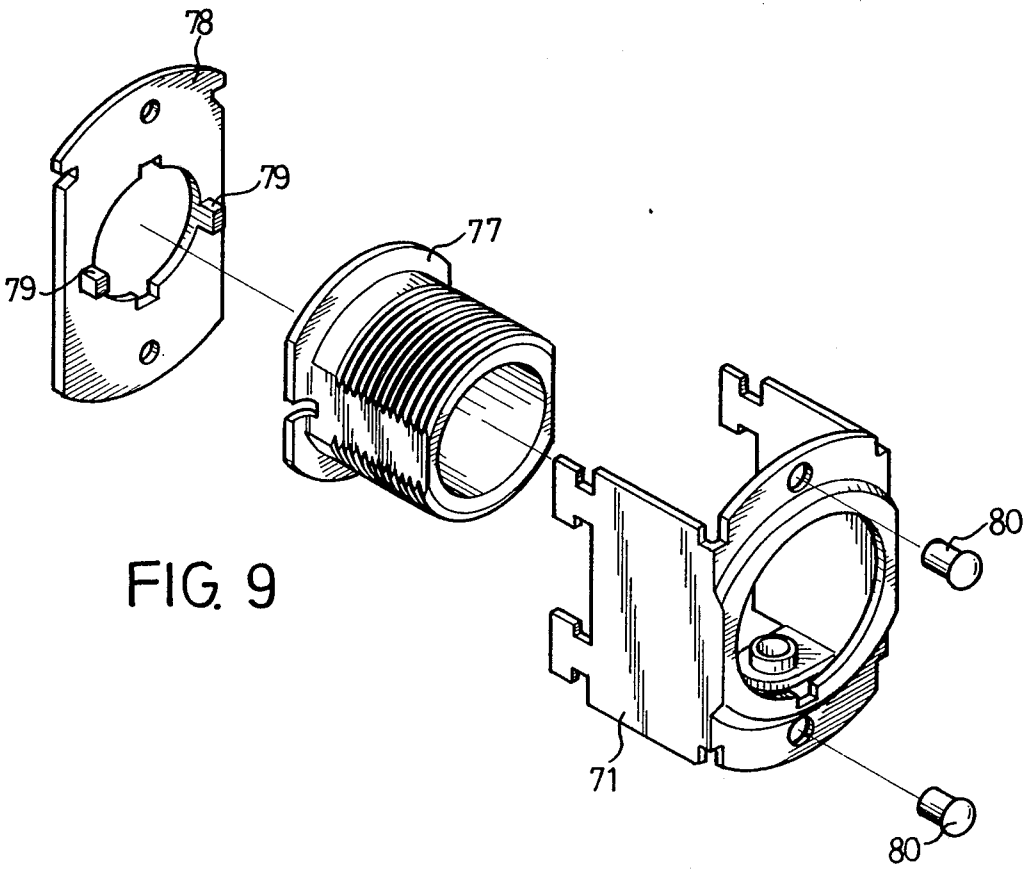
FIG. 9 is a fragmentary exploded view of spindle illustrating the hub and some neighbouring parts thereof.
Figure 10:
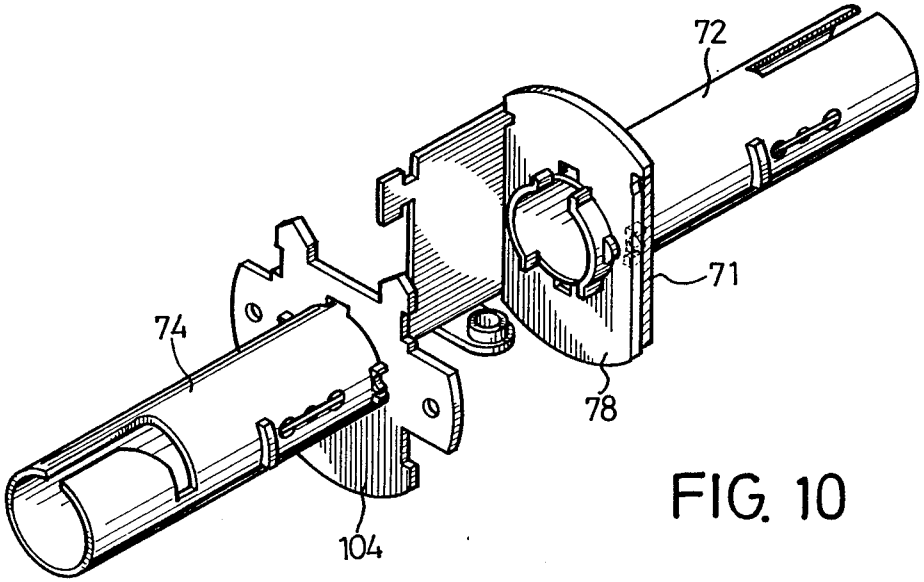
FIG. 10 is another view of the spindle viewed from another side thereof.

The hub 71 has an opening through which a threaded tube 77 is insertable, as depicted in FIG. 9. Provided on the other side of the hub 71 is an exterior hub plate 78. The exterior hub plate 78 having two stops 79 fits on an abutting face of the hub 71, as shown in FIG. 10. The stops 79 and two rivets 80 are provided to reinforce and to strengthen the structure.

Referring again to FIG. 8, fabricated within the cavity of the hub 71 are two slide springs 81, a plunger catch 82, and a slide 83 placed on said two slide springs 81, in sequence. Provided between the slide springs 81 and the slide 83 are two horizontally placed slide spring seats 84. Each of the slide spring seats 84 has a downward concave recess to urge the inner side of the slide spring 81 so as to avoid any undesirable displacement thereof. The plunger catch 82 is provided with a pair of plunger catch springs 85 on the bottom side thereof. Provided on an upper face of the slide 83 is a hook member 86. When the hub 71 is entirely installed within the housing 75, the hook member 86 is exactly caught by a cutout 87 of the housing 75.

The exterior spindle 72 which passes through the bore of the threaded tube 77 is generally a hollow tube fabricated with a set of locking plug assembly 73.

Figure 11:
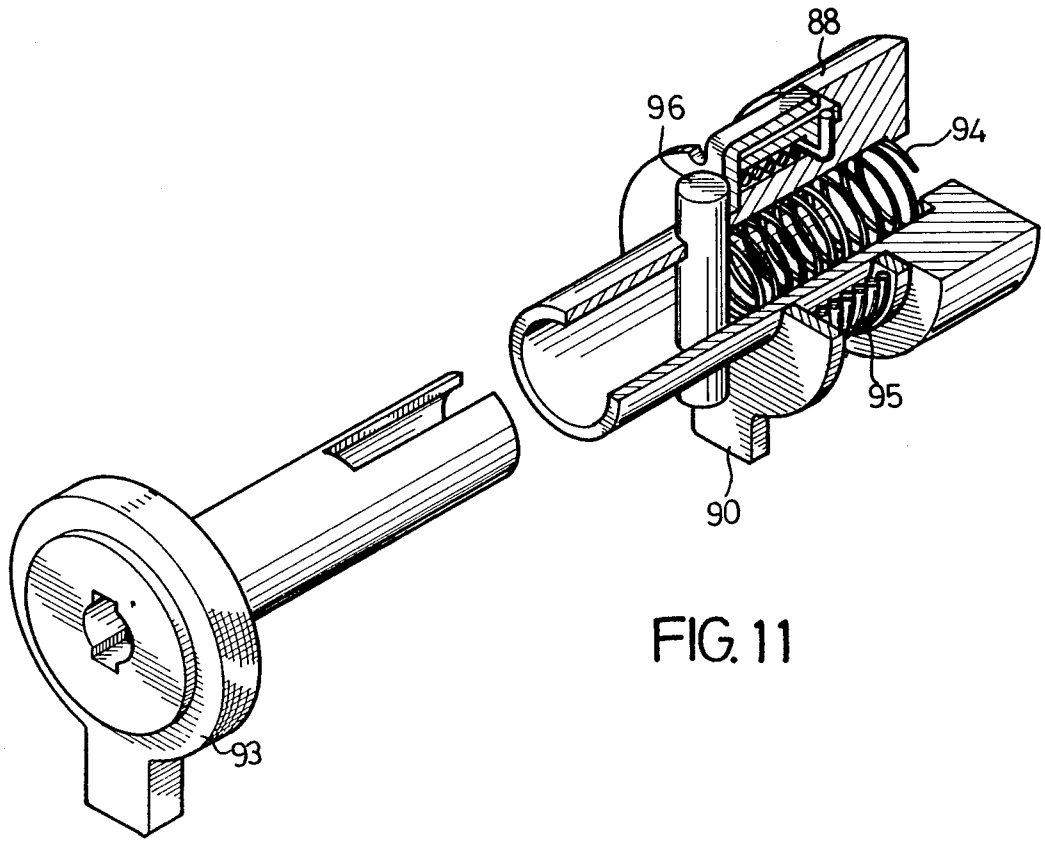
FIG. 11 is a schematic view of a locking plug assembly in assembled form.

The locking plug assembly 73 includes generally a key cam 88, a lower plug swivel 89, an upper plug swivel 90, a spacer 91, a locking ring 92, and a locking plug 93. The key cam 88 is designed to have three cylindrical sections of differing diameter. The middle section is flattened at two sides so as to be received by the lower plug swivel 89 which has an opening with two flattened sides thereon. When assembling the components, a key cam spring 94 is installed within the key cam 88, the lower plug swivel 89 is then inserted into the key cam 88, and a swivel spring 95 is placed on the lower plug swivel 89, such that projecting parts of the lower plug swivel 89 and upper plug swivel 90 are mounted on the open end of the swivel spring 95. A key cam pin 96 is inserted into a small hole of the key cam 88 and thereby fixes the upper plug swivel 90 to prevent any possible but undesirable drop out thereof, as depicted in FIG. 11.

The afore-described locking plug assembly 73 is then installed in the exterior spindle 72 with an extended part of the locking plug 93 inserted into the cavity of the key cam 88. The end part which presses the key cam spring 94 and the locking plug 93 is provided with a notch 97 to retain the key cam pin 96 therein. The projecting part of the upper plug swivel 90 is retained in a notch of the exterior spindle 72 (not shown). As a consequence, the swivel spring 95 is rotatable both counter-clockwise and clockwise. The spacer 91 is placed on the exterior spindle 72 to fix the whole assembled body. The locking ring 92 is combined with the locking plug 93 such that the locking ring 92 and the locking plug 93 move simultaneously either counter-clockwise or clockwise.

The corresponding ends of the exterior spindle 72 and interior spindle 74 are respectively provided with a pair of sidewardly extending wing members 98 and 99. When the primary spindle 18 is adjusted either by the exterior or the interior lever handle 14 or 15, the wing members 98 and 99 press the two ends of the slide 83 respectively. The slide 83 presses the slide spring 81, thereby retracting the latch bolt 22. The exterior spindle 72 and the interior spindle 74 are provided with knob catches 100 and 101 at one side, and another side thereof with protruders 102 and 103 respectively.

Referring again to FIG. 10, when the exterior spindle 72 passes through the exterior hub plate 78 or the interior spindle 74 passes through the housing 75 and the central opening of an interior hub plate 104, the protruders 102 pass through the notches on the central opening, thereby fixing the protruders 102 on the exterior hub plate 78, and the protruders 102 pass through the notches on the central opening, thereby fixing the protruders 103 on the exterior hub plate 78.

Figure 12:
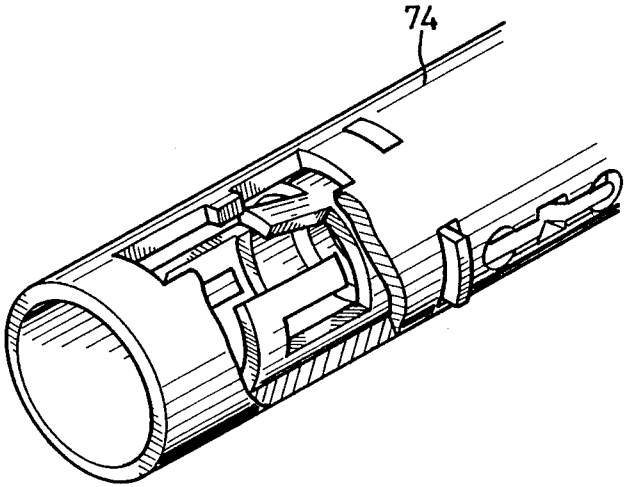
FIG. 12 is a view of an assembled interior spindle with a portion broken away for clarity.

Referring to FIGS. 8 and 12, it can be seen that the interior cavity of the interior spindle 74 is provided with a plunger assembly 76. The plunger assembly 76 includes a balance cap 105 on a plunger cylinder 106. The plunger cylinder 106 includes an extension on each side for the purpose of balancing the cylinder. A plunger bar 107, a button 108, a cotter pin 109, together with a plunger swivel 110 are assembled and installed within the interior spindle 74.

Figure 13:
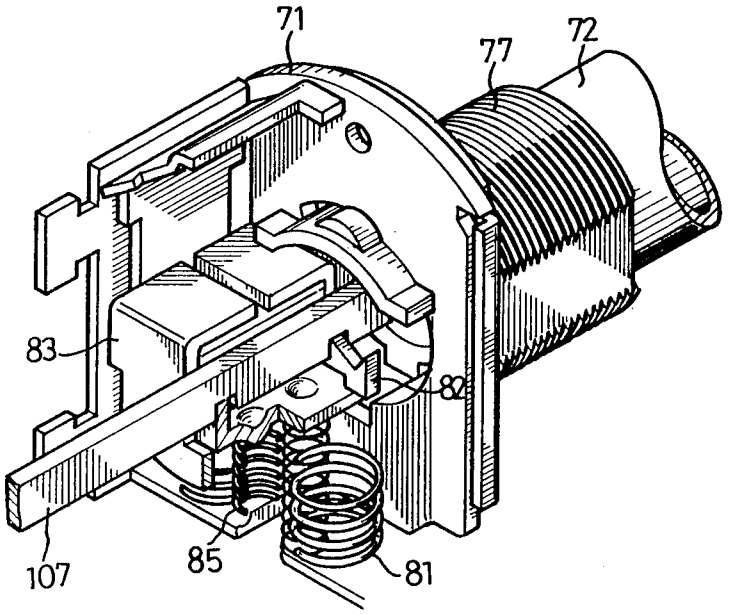
FIG. 13 is a view of the spindle, particularly illustrating the plunger assembly thereof.
Figure 14:
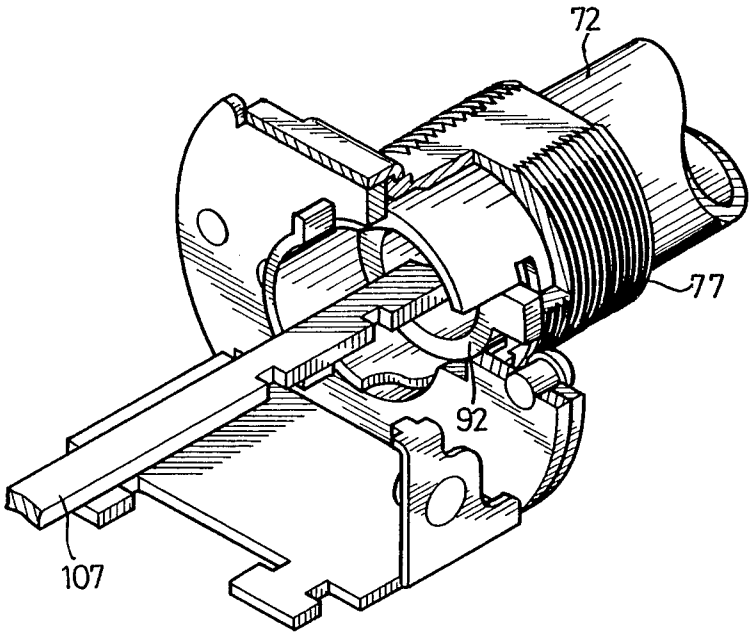
FIG. 14 is a view similar to FIG. 13, but illustrating the plunger assembly in its locked state.

Referring to FIGS. 13 and 14, when the button 108 of the plunger assembly 76 is pressed, the plunger bar 107 presses the locking plug 93 and the locking ring 92. The protruder of the locking ring 92 is entrapped by the notch of the exterior spindle 72 and the notch of the exterior hub plate 78. The two notches 111 on the plunger bar 107 are entrapped by the two pointed edges of the plunger catch 82, to prevent the plunger bar 107 from bounding out. At this juncture, the key cam spring 94 is under pressure and the exterior lever handle 14 is not rotatable, as shown in FIG. 13.

Figure 15:
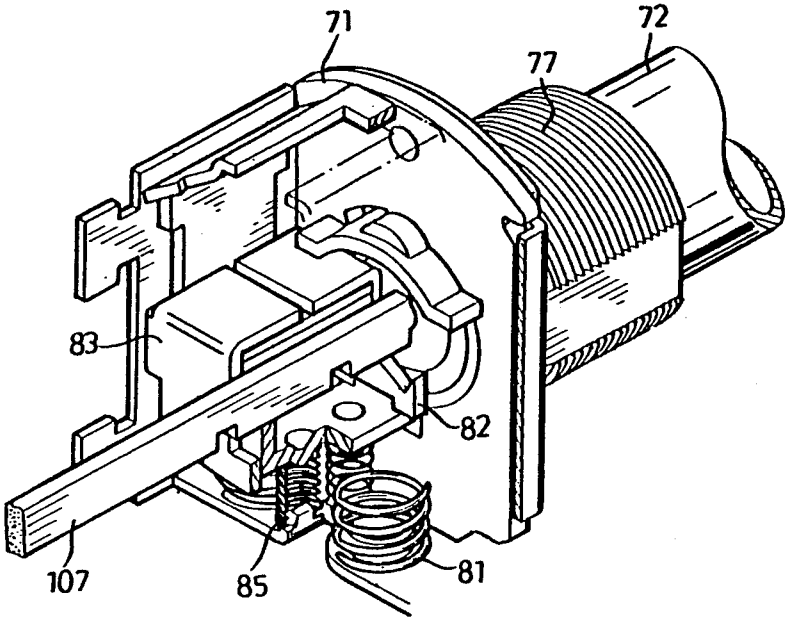
FIG. 15 is another view of the plunger assembly.
Figure 16:
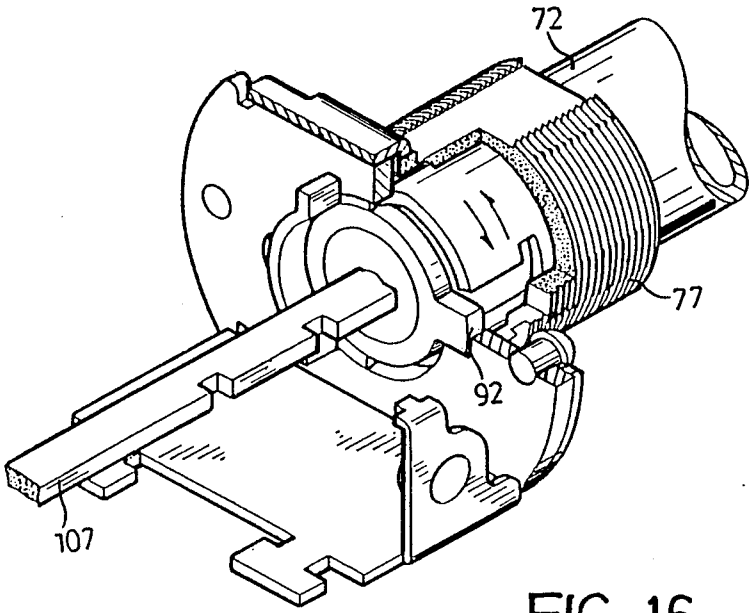
FIG. 16 is a view similar to FIG. 15, but illustrating the plunger assembly in its unlocked state.

Referring to FIGS. 15 and 16, when an outsider intends to unlock the lock unit 10, he has to use a key to actuate the well-define keyway so as to actuate the key cam 88 and locking plug 93. The plunger bar 107 is also actuated to a suitable position such that the plunger catch 82 stays away from the notch of the plunger bar 107. At this juncture, the button 108 will pop out, and that the exterior spindle 72 can be rotated in order in normal way so as to open the door.

As various possible embodiments might be made of the above invention without departing from the scope of the invention, it is to be understood that all matter disclosed herein is not intended to be limitative. Thus, it will be appreciated that the scope of the invention be rather limited to the scope of the attached claims.

I claim:

1. A heavy-duty panic proof lock unit (10) having a latch bolt mechanism (11), a dead bolt mechanism (12), and a cartridge mechanism (13); said latch bolt mechanism (11) being coupled with a key actuated exterior lever type handle (14) and an interior lever type handle (15) for easier operation, and cooperating with a primary spindle (18); said dead bolt mechanism (12) being coupled with a key actuated rosette (16) on an exterior and a thumb turn (17) on an interior, and cooperating with a secondary cylinder (24);

characterized in that said cartridge mechanism (13) comprises a first cartridge plate (27), a second cartridge plate (28), a rocker lever (29), a collar (30), an H-shaped slide (31), a rotary lever (32), a spring-loaded catch (33); four screws (34), and four screw supporting shells (35);

said cartridge plates, (27) and (28), being separate and distinct, and generally a rectangular flat plate, each plate being pierced by an opening (37) large enough to accommodate said primary cylindrical spindle (18) for ready rotation and another opening (38) large enough to accommodate said secondary spindle (24) for rotation; said cartridge plates (27) and (28) being arranged with respect to each other so as to leave an intervening space (37) therebetween; said cartridge plates (27) and (28) having two pair of apertures (45) and (46) to receive screws (34) and screw supporting shells (35) therethrough; apertures (45) being provided at both sides of said opening (38) horizontally, apertures (46) being provided at an upper and lower part of said opening (37) vertically; a pair of arcuate circumferential folds (47) being provided proximate to and around said opening (38), and a pair of arcuate circumferential folds (48) proximate to and around said opening (37) both for strengthening said structure thereof; a pair of partial circumferential rims (49) around said opening (37) being provided to reinforce said structure thereof; three shallow grooves (50) being provided to facilitate the up-and-down movement of said H-shaped slide (31); four short assembly screws (a), (b), (c), (d) being provided to combine said cartridge plates (27) and (28);

said rocker lever (29) being slidably assembled on said primary cylindrical spindle (18); said rocker lever (29) being symmetrical about a median plane and including a drive ring (51) having an opening (52) therethrough of a size to accommodate said primary cylindrical spindle (18); said drive ring (51) having two oppositely spaced, inwardly concave notches (53) designed to cooperate with said collar (30); said rocker lever (29) having a pair of lever arms (51) partially forming an intervening arcuate window and letting said screw supporting shells (35) and said screws (34) passing therethrough;

said collar (30) being a ring-shaped plate having approximately a same size with said opening (52) of said drive ring (51) and comprising two outwardly projecting teeth (56) at opposite locations for cooperating with said notches (53) respectively; said collar (30) also having an inwardly projecting tooth (57) designed to fit in and to slide along said spindle slot and to transmit rotary force between said primary cylindrical spindle (18) and said rocker lever (29);

said H-shaped slide (31) cooperating with said rocker lever (29); said slide (31) being generally a flat plate including two downwardly extending legs (58) and two upwardly extending legs (59) said two downwardly extending legs (58) being initially constant in width and at a suitable position begin to be tapered in width; said two upwardly extending legs (59) being both constant in width; an inwardly projecting tab (60) being formed on each of said downwardly extending legs (58); said two inwardly projecting tabs (60) facing toward each other being provided such that said configuration of said H-shaped slide (31) cooperates better with said rocker lever (29);

said rotary lever (32) being provided to cooperate with said secondary spindle (24); said rotary lever (32) being generally an arch-shaped flat plate including a central circular journal (61) having a rectangular slot (62) pierced therethrough to receive and slide on said secondary spindle (24) and to make said rotary lever (32) non-rotatable with respect thereto; said configuration of said rotary lever (32) forms arcuate cutout portions (63) and (64) which define passages for screws (34) and screw supporting shells (35); said rotary lever (32) including a tail (65) having inclined face which matches said leg (59) of said H-shaped slide (31), such that said rotary lever (32) cooperates better with said slide (31);

said spring-loaded catch (33) being a resilient metal wire emplaced below said rocker lever (29);

said collar (30) being entrapped in said opening (52) of said drive ring (51), with said two outwardly projecting teeth (56) thereof retained within said notches (53) of said rocker lever (29); said notches (53) being slightly larger than said outwardly projecting teeth (56) so as to permit an extra 20 degrees rotation of said collar (30) in either direction with respect to said rocker lever (29);

a first screw (34*a*) passing through one of said apertures (45) of said second cartridge plate (28), said arcuate cutout portion (61), a first screw supporting shell (35*a*), said corresponding aperture (45) on said first cartridge plate (27), and engaging with a first retention slot (67) of said dead bolt mechanism (12);

a second screw (34*b*) passing through another aperture (45) of said second cartridge plate (28), said arcuate cutout portion (62), a second screw supporting shell (35*b*), said corresponding aperture (45) on said first cartridge plate (27), and engaging with a second retention slot (68) of said dead bolt mechanism (12);

a third screw (34*c*) passing through one of said apertures (46) of said second cartridge plate (28), a space between said H-shaped slide (31) and said rocker lever (29), a third screw supporting shell (35*c*), said corresponding aperture (46) on said first cartridge plate (27), and engaging with a third retention slot (69) of said latch bolt mechanism (11);

a fourth screw (34*d*) passing through another aperture (46) of said second cartridge plate (28), said arcuate window of said rocker lever (29), a fourth screw supporting shell (35*d*), said corresponding aperture (46) on said first cartridge plate (27), and engaging with a fourth retention slot (70) of said latch bolt mechanism (11);

said primary cylindrical spindle (18) comprising a hub (71), an exterior spindle (72), a locking plug assembly (73), an interior spindle (74), a housing (75), and a plunger assembly (76) fabricated in a conventional manner; characterized in that said hub (71) has an opening through which a threaded tube (77) is insertable, an exterior hub plate (78) having two stops (79) being fitted on an abutting face of said the hub (71), said stops (79) and two rivets (80) being provided to reinforce and to strengthen the structure thereof;

said hub (71) being provided in an interior cavity thereof with two slide springs (81), a plunger catch (82), and a slide (83) placed on said two slide springs (81), in sequence; two horizontally placed slide spring seats (84) being provided between said slide springs (81) and said slide (83); each of said slide spring seats (84) having a downward concave recess to urge the inner side of the slide spring (81) so as to avoid any undesirable displacement thereof; said plunger catch 82 being provided with a plunger catch spring (85) on the bottom side thereof; a hook member (86) being provided on an upper face of said slide (83) such that said hook member (86) is exactly caught by a cutout (87) of said housing (75) when said hub (71) is entirely installed within said housing (75);

said exterior spindle (72) which passes through the bore of said threaded tube (77) being generally a hollow tube fabricated with a set of locking plug assembly (73);

said locking plug assembly (73) including a key cam (88), a lower plug swivel (89), an upper plug swivel (90), a spacer (91), a locking ring (92), and a locking plug (93); said key cam (88) having three cylindrical sections of differing diameters; a middle cylindrical section being flattened at two sides so as to be received by said lower plug swivel (89) having an opening with two flattened sides thereon; when assembling said components, a key cam spring (94) being installed within said key cam (88), said lower plug swivel (89) being inserted into said key cam (88), and a swivel spring (95) being placed on said lower plug swivel (89), such that projecting parts of the lower plug swivel (89) and upper plug swivel (90) are mounted on open end of said swivel spring (95); a key cam pin (96) being inserted into a small hole of said key cam (88) and thereby fixing said upper plug swivel (90) to prevent any undesirable drop out thereof;

said locking plug assembly (73) being installed in said exterior spindle (72) with an extended part of said locking plug (93) inserted into the cavity of said key cam (88); said end part which presses said key cam spring (94) and said locking plug (93) being provided with a notch (97) to retain said key cam pin (96) therein; said projecting part of said upper plug swivel (90) being retained in a notch of said exterior spindle (72), thereby causing said swivel spring (95) to be counter-clockwise and clockwise rotatable; said spacer (91) being placed on said the exterior spindle (72) to fix said whole assembled body; said locking ring (92) being combined with said locking plug (93) such that said locking ring (92) and said locking plug (93) move simultaneously either counter-clockwise or clockwise;

corresponding ends of said exterior spindle (72) and said interior spindle (74) being respectively provided with a pair of sidewardly extending wing members (98) and (99); when said primary spindle (18) is adjusted either by said exterior or interior lever handle (14) or (15), said wing members (98) and (99) press the two ends of said slide (83) respectively; said slide (83) pressing said slide spring (81) to thereby retracting said latch bolt (22); said exterior spindle (72) and said interior spindle (74) being provided with knob catches (100) and (101) at one side respectively and another side thereof provided with protruders (102) and (103) respectively;

when said exterior spindle (72) passes through said exterior hub plate (78) or said interior spindle (74) passing through said housing (75) and said central opening of an interior hub plate (104), said protruders (102) pass through said notches on the central opening, thereby fixing the protruders (102) on said exterior hub plate (78), and said protruders (102) pass through said notches on said central opening, thereby fixing said protruders (103) on said exterior hub plate (78);

an interior cavity of said interior spindle (74) being provided with a plunger assembly (76); said plunger assembly (76) including a balance cap (105) on a plunger cylinder (106); said plunger cylinder (106) includes an extension on each side for the purpose of balancing effect; a plunger bar (107), a button (108), a cotter pin (109), together with a plunger swivel (110) being assembled and installed within said interior spindle (74);

when said button (108) of said plunger assembly (76) is being pressed, said plunger bar (107) presses said locking plug (93) and said locking ring (92); said protruder of said locking ring (92) being entrapped by the notch of said exterior spindle (72) and the notch of said exterior hub plate (78); said two notches (111) on said plunger bar (107) being entrapped by said two pointed edges of said plunger catch (82), to prevent said plunger bar (107) from bounding out, and thereby causing said key cam spring (94) under pressure and said exterior lever handle (14) not rotatable.

2. A heavy-duty panic proof lock unit (10) as set forth in claim 1, wherein said cartridge plates (27) and (28) being provided with an unturned edge flange (38) and a top and bottom flanges (39) and (40) along one edge respectively; each of said flanges (38), (39) and (40) being of a dimension to provide said intervening space (37) when said two cartridge plates (27) and (28) being superposed with said flanges of one abutting said surface of another.

3. A heavy-duty panic proof lock unit (10) as set forth in claim 1, wherein said cartridge plates (27) and (28) having a lug (41) projecting from a tab (42) respectively such that openings (37) and (38) of said cartridge plates (27) and (28) being in appropriate axial registry.

4. A heavy-duty panic proof lock unit (10) as set forth in claim 1, wherein each of said cartridge plates (27) and (28) is provided with three shallow grooves to facilitate the up-and-down movement of the H-shaped slide (31).

* * * * *